US007021860B1

(12) United States Patent
Bolstad

(10) Patent No.: US 7,021,860 B1
(45) Date of Patent: Apr. 4, 2006

(54) STRIPE LAYOUT ASSEMBLY

(76) Inventor: Brian K. Bolstad, 29171 Vale St. NW., Isanti, MN (US) 55040-6075

( * ) Notice: Subject to any disclaimer, the term of this patent is extended or adjusted under 35 U.S.C. 154(b) by 0 days.

(21) Appl. No.: 10/773,413

(22) Filed: Feb. 5, 2004

Related U.S. Application Data

(60) Provisional application No. 60/445,496, filed on Feb. 6, 2003.

(51) Int. Cl.
*E01C 23/16* (2006.01)

(52) U.S. Cl. ..... 404/94; 404/93; 239/164

(58) Field of Classification Search ..... 404/93, 404/94; 239/159, 164, 165, 166, 170, 176
See application file for complete search history.

(56) References Cited

U.S. PATENT DOCUMENTS

| | | | | | |
|---|---|---|---|---|---|
| 2,304,726 | A | * | 12/1942 | Beaman | 239/73 |
| 2,518,952 | A | * | 8/1950 | Sohmer | 239/150 |
| 2,692,799 | A | * | 10/1954 | Parrott | 239/152 |
| 3,148,833 | A | * | 9/1964 | Wilson et al. | 239/150 |
| 3,949,937 | A | * | 4/1976 | Sortwell et al. | 239/70 |
| 4,267,973 | A | | 5/1981 | Stewart | |
| 4,447,007 | A | * | 5/1984 | Farines | 239/165 |
| 4,545,531 | A | | 10/1985 | Williams | |
| 4,599,968 | A | * | 7/1986 | Ryder et al. | 118/305 |
| 4,624,602 | A | | 11/1986 | Kieffer et al. | |
| 4,793,559 | A | * | 12/1988 | Marlek | 239/722 |
| 4,861,190 | A | | 8/1989 | Glassel | |
| 4,893,751 | A | | 1/1990 | Armstrong | |
| 5,054,959 | A | | 10/1991 | Wilson et al. | |
| 5,302,207 | A | | 4/1994 | Jurcisin | |
| 5,312,043 | A | | 5/1994 | Whitney | |
| 5,368,232 | A | | 11/1994 | Schroeder | |
| 5,947,637 | A | | 9/1999 | Neuling | |
| 5,951,201 | A | | 9/1999 | Jones | |
| 6,330,503 | B1 | * | 12/2001 | Sharp et al. | 701/50 |
| 6,367,712 | B1 | * | 4/2002 | Larsen | 239/159 |
| 6,402,051 | B1 | * | 6/2002 | Humpal | 239/166 |
| 6,413,012 | B1 | | 7/2002 | Jones | |
| 6,698,774 | B1 | * | 3/2004 | Duncan | 280/63 |
| 6,702,516 | B1 | * | 3/2004 | Harrison | 404/93 |

* cited by examiner

*Primary Examiner*—Gary S. Hartmann
(74) *Attorney, Agent, or Firm*—Anthony G. Eggink; Katrina M. Eggink

(57) ABSTRACT

A stripe layout assembly for attachment to a paint striping machine. The assembly has an adjustable arm, a line marking device and structure to activate the marking device. The assembly may be provided with an adjustment device to permit the assembly to be rotated and set at a specified angle with respect to the striping machine. Once a single line has been determined to form a plurality of parking spaces, for example, the stripe assembly of the invention provides a parallel line each time a stripe is painted.

8 Claims, 2 Drawing Sheets

STRIPE LAYOUT ASSEMBLY

This application claims the benefit of U.S. Provisional Application Ser. No. 60/445,496, filed on Feb. 6, 2003.

BACKGROUND OF THE INVENTION

This invention relates generally to a stripe layout assembly. Particularly, this invention relates to a stripe layout assembly for attachment to a paint striping machine utilized for painting stripes in parking lots, roadways and the like.

The painting of stripes in the preparation of automobile parking lots, for example, has generally been a time consuming operation. After a parking lot surface has been laid or otherwise prepared, the individual parking spaces as well as walkways, cross-walks, handicap parking and no parking areas, for example, need to be designed, laid out and painted onto the lot or roadway surface to thereby create the parking lot. Typically, the preparation of such parking lots and roadways involve the layout and marking of a series of parallel lines which are subsequently individually painted onto the lot surface.

In the past, each line of a parking space or no parking area, for example, was individually marked, requiring careful measuring, laying and securing a line and then the physical marking of each parallel line. The layout of a series of the individual parallel lines was found time intensive involving individually measuring and moving of a line in parallel segments and then requiring the paint striping on the pavement along each positioned line utilizing a paint striping machine.

The stripe layout assembly of the present invention provides an attachment to a paint striping machine which enables the marking of a parallel line each time a single stripe is painted. The assembly may be activated whereby a line is drawn or placed a specified distance parallel the painted stripe thereby only requiring the marking of an initial single line. The assembly of the invention therefore provides a time saving and more economical method of marking and painting a parking lot.

The present invention also relates to an attachment to a paint striping machine which is rotatable with respect to the machine and whereby the marking device may be disposed at a predetermined angle with respect to the machine. Further, the attachment of the present invention provides means to activate the marking means at the distal end of adjustable arm.

SUMMARY OF THE INVENTION

A stripe layout assembly comprising an adjustable arm, attachable to a striping machine, a marking means and means to activate the marking means. The adjustable arm is attached on one end to a paint striping machine via a hinge, for example. The adjustable arm may have a plurality of telescoping sections to permit extension of the arm a specified distance from the machine. A wheel may be provided at the distal end of the adjustable arm to provide stability. A marking means is attached to the adjustable arm at the distal end inward the wheel. The marking means may comprise an extension bracket having a marking element such as a stick of chalk, a chalk dispenser, etching or scribing element attached thereto, for example.

The activation means, such as a cable connected at one end to the adjustable arm and an operating lever at the opposite end may be provided accessible to the operator of the paint striping machine. Preferably, the operating lever is positioned at the location of the other control levers of the striping machine. When activated the marking means becomes operational when the paint striping machine is moved and thereby marking a parallel line with respect to the painted stripe.

The invention further provides means to attach the assembly to a striping machine, various means to provide a parallel line and means to store the stripe layout assembly onto the striping machine.

An advantage of the present invention is to provide an attachment assembly for a paint striping machine which simultaneously provides a parallel line as a stripe is being painted by the striping machine.

Another advantage of the present invention is to provide an adjustable marking attachment for a paint striping machine which is rotatable with respect to the machine and whereby the marking device may be disposed at a predetermined angle with respect to the striping machine. Further, the attachment of the present invention provides means to activate the marking means at the distal end of adjustable arm, whereby the marking element, such as chalk or other marking means may be activated when desired.

These and other benefits of this invention will become apparent from the following description by reference to the drawings.

DESCRIPTION OF THE PREFERRED EMBODIMENTS

Figure 1:
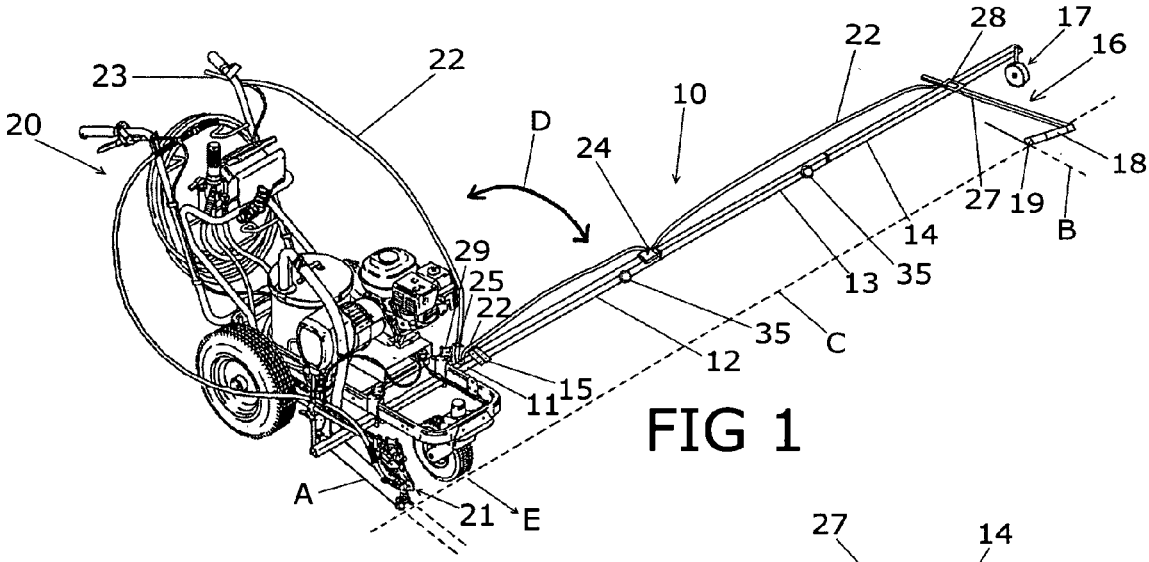
FIG. 1 is a perspective view of a paint striping machine having the stripe layout assembly of the present invention attached thereto.
Figure 2:
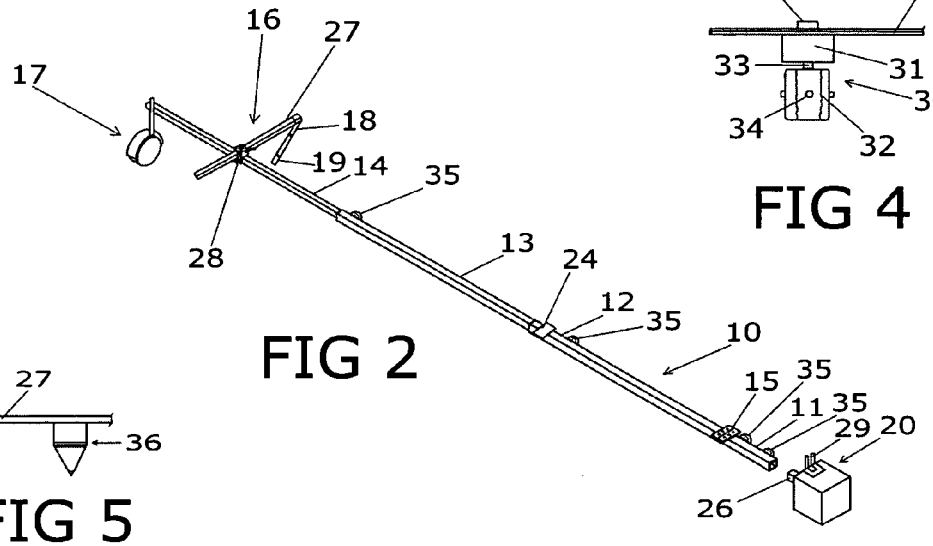
FIG. 2 is a perspective view of the stripe layout assembly of FIG. 1.
Figure 3:
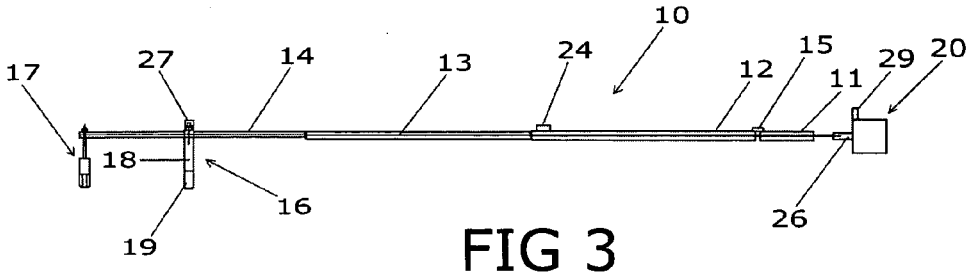
FIG. 3 is a lateral plan view showing the stripe layout assembly of FIG. 2.

Referring to FIGS. 1–3, the stripe layout assembly 10 of the present invention is shown attached to a paint striping machine 20. Paint striping machines are known and are sold by Graco Inc. of Minneapolis, Minn. under the trademark LineLazer and also by Titan Tool Inc. under the PowrLiner mark, for example. The stripe layout assembly 10 is shown comprised of a stationary arm 11 which is connected to a hinge 15 at one end and which is connected at the other end to a post 26, which is secured to the striping machine 20. A pair of threaded knobs 35 are shown used to secure the arm section 11 to the post 26. The threaded knobs 35, each having a knob portion and a threaded shaft, are screwed into pre-threaded apertures in the stationary arm 11 to thereby abut the post 26 and secure the stripe layout assembly 10 to the striping machine 20. Alternate securing means may be used within the purview of the invention. The post 26 may be part of the paint striping machine 20 as shown in FIG. 1 or may be a separate attachment to the frame of the striping machine 20, for example.

The hinge 15, i.e., a 2×3 inch hinge, may be shown provided to permit the stripe layout assembly 10 to be placed in an upright stored position and also to allow the assembly 10 to negotiate uneven terrain as the assembly is being used. Connected to the other side of hinge 15 is the adjustable portion of the arm which is comprised of arm sections 12, 13 and 14. Preferably, the latter sections are telescoping in structure, thereby making the arm adjustable. Thus, arm section 13 may have sectional dimensions to permit sliding into arm section 12 and arm section 14 has dimensions to permit sliding into section 13. The latter adjustable arm sections are exemplary and may also take the form of adjustable threaded sections or adjustable frictionally held members. Locking devices, such as the threaded knobs 35, may be utilized to secure the adjustable sections with respect to each other. The threaded knobs 35 are described above and are utilized in pre-threaded apertures in arm sections 12 and 13. Alternate locking or securing devices may, however, be utilized in the invention.

A wheel assembly 17 is shown attached at the distal end of arm section 14 to provide stability to the adjustable arm. The wheel assembly 17 may comprise a four inch diameter rubber caster type wheel. An extension bracket 16 is also shown attached to arm section 14 by means of adjustable bracket 28. The extension bracket 16 is shown comprised of an extension arm 27 having a holder 18 for a stick of chalk 19, and which may be adjusted with respect to arm segment 14. The chalk stick 19 is shown held by holder 18 and the chalk 19 may be pulled downward as required. Alternatively, other marking means, such as a chalk dust dispenser, may be utilized as will be discussed further with respect to FIG. 4. Marking means may include, for example, a scribing or etching element such as a metallic element, i.e. aluminum, which wears slowly and leaves a mark when engaging a parking lot surface, for example.

As shown in FIG. 1, the marker or chalk 19 is aligned with the spray head assembly 21 of the striping machine 20, as shown by dotted line C. Thus, as the machine 20 is moved forward, as indicated by arrow E, to paint stripe A, the chalk 19 creates a line B, and which is parallel to stripe A. The spacing between stripe A and line B (dotted lines indicate stripe and line to be painted and marked, respectively) may be adjusted by manipulating the telescoping arm sections 12, 13 and 14 and locking them in place. For example, the parallel spacing for a typical parking stall is approximately nine feet, thus, the desired distance between the spray head 21 and the chalk 19 is approximately nine feet.

As further shown in FIG. 1, a cable 22 is shown extending at one end to arm section 14 and held by cable attachment 24, shown mounted on arm section 12. At the opposite end of cable 22, a lever 23 is shown mounted to the operating bar of the paint striping machine 20. At an intermediate portion, the cable 22 is shown mounted at cable attachment 25, which may be mounted on arm section 11, for example. Thus as the lever 23 is operated the arm is positioned in its downward position as shown in FIG. 1 and having the marking element such as chalk 19 in contact with the pavement. When the lever 23 is released, extension bracket 16 moves upward, thereby moving the chalk 19 upward from the pavement. Alternatively, the entire arm (sections 12, 13 and 14) may be moved up and down. The lever 23 therefore, functions similar to a hand brake control and operates to release the assembly 10 to an operational state when squeezed. The cable 22 is preferably attached to the extension bracket 16 to thereby control the activation of the marking means via the lever 23.

The operating bar of the striping machine 20 additionally has on one side an operating lever to activate the spray head assembly 21 and a second lever to permit turning of the front wheel of the striping machine 20. Typically, the front wheel of the machine is locked to thereby provide a straight motion.

As further shown in FIGS. 1–3, the paint striping machine 20 may be provided with a lockdown bracket 29 which is constructed and arranged to receive the arm section 12. Thereby, the telescoping arm sections 13 and 14 may be moved in their respective inside positions to place the collapsed stripe layout assembly 10 locked into bracket 29 and placed in a stored position on the striping machine 20. Arrow D in FIG. 1 illustrates the path of movement of the layout assembly between the operational and storage positions.

Figure 4:
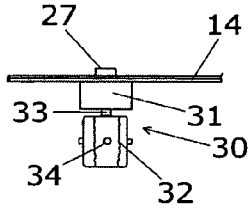
FIG. 4 is an alternate embodiment of the line marking structure of the invention.

Referring to FIG. 4, a chalk dispenser device 30 is shown for use in marking the parallel line B. A chalk container 31 is shown attached to extension arm 27 which provides adjustability with respect to the adjustable arm. The container 31 has at least one bottom aperture (not shown) and a dispensing tab 33 which permits the chalk to drop from the container 31. A marking wheel 32, i.e., a spring wheel, is shown positioned below the container 31. The wheel 32 has an activating member 34 which is aligned to strike dispensing tab 33, whereby upon wheel 32 rotation, chalk is dispensed and dropped onto the wheel 32 surface for transfer onto the pavement to provide the parallel line.

Figure 5:
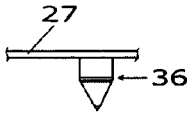
FIG. 5 is another embodiment of the line marking structure.

Alternatively, as shown in FIG. 5, an inverted bottle or container 36 having chalk powder therein may be attached to extension arm 27 to provide marking means. Various marking means may be used in the assembly 10 of the invention. For example, a wheel similar to the wheel 32 shown in FIG. 4 may be mounted for rotation directly to extension arm 27. The wheel may have an internal cavity to receive chalk powder and have spring pins on the periphery of the wheel surface to thereby release chalk from the wheel cavity upon rotation as the spring pins are activated. Further, other etching or scribing elements may be used within the purview of the invention. The marking means may therefore include various marking, etching or scribing materials so that the user of the stripe layout assembly may be guided when painting the stripe.

Figure 6:
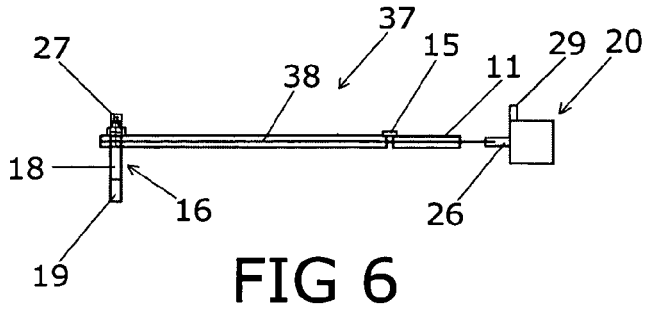
FIG. 6 is a lateral plan view showing another embodiment of the stripe layout assembly of the present invention.

FIG. 6 shows stripe layout assembly 37 having a relatively shortened and single arm section and to which extension bracket 16 and marking element 19 is mounted at the terminal end thereof. The layout assembly 37 is shown having arm section 38 which may be directly mounted to paint striping machine 20 or to arm 11 and hinge member 15 as previously described. The relatively short arm 38 is shown not having a wheel, for example, and may be used for cross hatching purposes. The marking means at the terminal end of arm 38 may be a chalk stick 19, or other marking element as described above, and may be mounted 1.5, 3 or 4 feet from the spray head of the striping machine, for example.

Figure 7:
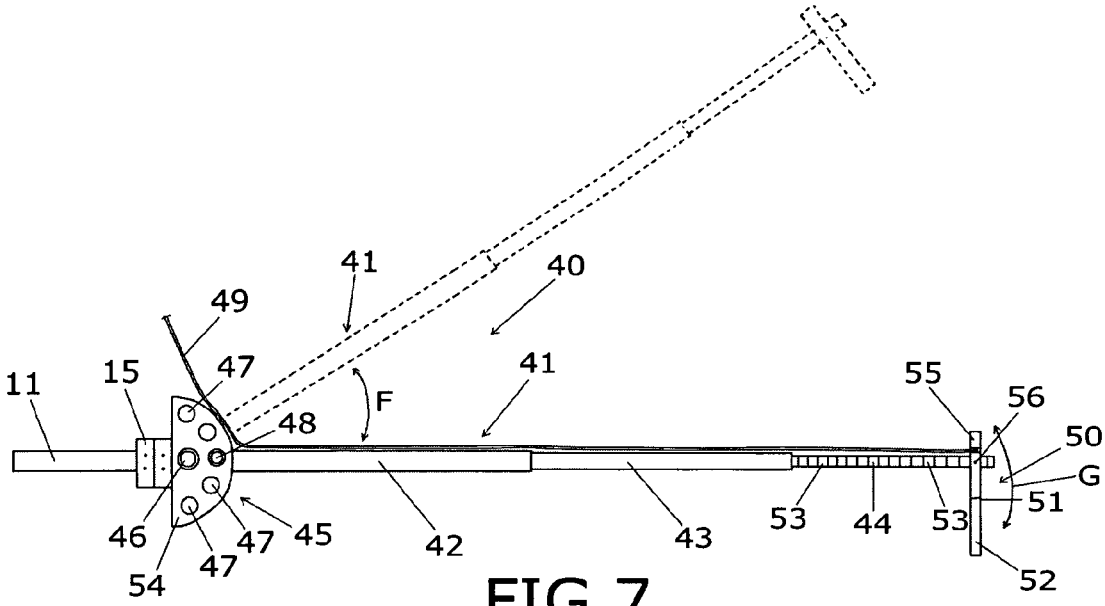
FIG. 7 is a top plan view of another stripe layout assembly of the present invention.
Figure 8:
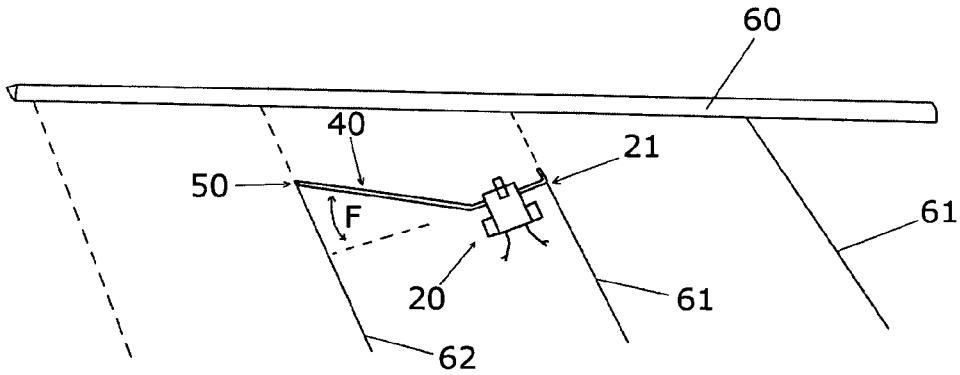
FIG. 8 is a top plan view of a parking lot showing a paint striping machine having the attachment of the present invention and marking a contemporaneous parallel line to a stripe being painted at an angle to a curb.

In another embodiment, as shown in FIGS. 7 and 8, a stripe layout assembly 40 is shown attached to paint striping machine 20. Referring particularly to FIG. 8, machine 20 is shown painting stripe 61 while the stripe layout assembly 40 attached to machine 20 is simultaneously shown marking line 62 parallel to stripe 61. As shown, the assembly 40 is positioned at angle F with respect to machine 20, thereby providing that the marking assembly 50 reaches curb 60 at approximately the same time as the spray head assembly 21 of machine 20 paints stripe 61 up to curb 60. Thus, the entire parallel line 62 is laid out for subsequent striping.

As shown particularly in FIG. 7, the stripe layout assembly 40 comprises a stationary arm 11 which is constructed for connection to the machine 20, the same as discussed above with respect to assembly 10. The assembly 40 has arm sections 42, 43 and 44 which may be constructed to be telescoping in nature. A hinge 15 is provided so that assembly 40 may be positioned in an upward storage configuration.

Differing from assembly 10 of FIGS. 1–3, the adjustable arm 41 is shown to have an adjustment device 45 connected to arm section 42 and which permits arm 41 to be rotated and locked in position as shown by angle F. Adjustment device 45 is shown having a plate 54 with a series of apertures 47. A pivot pin 46 is shown within plate 54 and connected to arm section 42. A spring pin 48 is shown positioned in one aperture 47 to thereby lock the adjustable arm 41 in place. Spring pin 48 is also connected to arm section 42. Thus, plate 54 is stationary with respect to hinge 15 and due to the rotation of pivot pin 46 with respect thereto, permits the adjustable arm 41 to be rotated and locked in place with respect to plate 54. Thus, as shown in FIG. 7, spring pin 48 would be positioned in the adjacent aperture 47 when rotated to the dotted position. Other rotation and locking means may be utilized in this invention. For example, a ratchet type engagement with locking means may be used to provide for smaller increments of rotation.

The adjustable arm 41 is further shown to have cable 49 extending therealong and attached to the marking assembly 50. The opposite end of the cable (not shown) is connected to an operational level at the controls of the machine 20, i.e., lever 23 as shown in FIG. 1. When the lever is activated, i.e., squeezed, the marking assembly 50 is moved, as indicated by the arrow G, whereby the holder 51 and chalk 52 are rotated downward to engage the surface of the pavement to be marked. Although the holder 51 and chalk stick 52 are shown in assembly embodiment 40, other marking means including etching and scribing means, as discussed above, may also be utilized in the teachings of the present rotatable assembly. Further, the wheel assembly 17 shown in FIGS. 1–3 may be disposed at the distal end of the adjustable arm 41 of the present embodiment.

The arm section 44 is further shown to have gradations or markings 53 which will permit the operator to easily measure the marking distance from the stripe being painted. For example, the gradations may show a distance of 8–10 feet from the spray head assembly 21.

Although cable 22 is shown attached to the arm section and may be constructed and arranged to pivot the adjustable arm upward for storage or disengagement from the surface as discussed with respect to FIGS. 1–3, the cable 22 may also be connected directly to the marking device or other marking means for operation. It is further within the purview of the invention that the stripe layout assembly embodiments of the invention may be mounted to a paint striping machine in any known manner, i.e., by connection to a post, either existing or fastened to the machine, or otherwise fastening directly to a frame portion of the machine.

As many changes are possible to the stripe layout assembly embodiments of this invention, utilizing the teachings thereof, the description above and the accompanying drawings should be interpreted in the illustrative and not the limited sense.

What is claimed is:

1. A stripe layout assembly for use with a hand operable paint striping machine comprising:

a) an elongated arm member having a connecting end member and a distal end, said connecting end member being constructed and arranged for connection to a paint striping machine with a paint spray head mounted at the front thereof, said arm member having a hinge member providing vertical movement for said elongated arm member;

b) marking means attached at the distal end of said elongated arm member, said marking means comprising a movable extension bracket and a marking element mounted thereto; and c) activation means operable from the paint striping machine and being communicatively connected to said extension bracket to position and align said marking means with respect to the paint spray head of the striping machine and with the surface to be marked.

2. The stripe layout assembly of claim 1, wherein said elongated arm member comprises an adjustable arm having a plurality of telescoping arm sections.

3. The stripe layout assembly of claim 1, wherein a wheel is mounted at said distal end of said elongated arm member.

4. The stripe layout assembly of claim 1, wherein said marking element is selected from the group of marking elements consisting of a stick of chalk, a chalk dispenser, an etching element and a scribing element.

5. The stripe layout assembly of claim 1, wherein said activation means comprises a cable connected at one end to said extension bracket of said elongated arm member and to an operating lever at the opposite end.

6. The stripe layout assembly of claim 5, wherein said operating lever is mounted to the paint striping machine.

7. The stripe layout assembly of claim 1, wherein said connecting end member includes an horizontal adjustment device which permits the horizontal rotation of said arm member with respect to the paint spray head of the paint striping machines said adjustment device having a plate member with adjustment apertures, a pivot pin and a locking pin for positioning in said adjustment apertures.

8. The stripe layout assembly of claim 1, wherein said elongated arm member comprises a plurality of adjustable arm sections including a terminal arm section each having measuring marks to aid in the positioning of said marking means.

* * * * *